United States Patent [19]

Preus

[11] 4,201,495

[45] May 6, 1980

[54] PROTECTED AQUATIC SPORTS AREA

[76] Inventor: Paul Preus, 21 Smith Rd., Toms River, N.J. 08753

[21] Appl. No.: 920,716

[22] Filed: Jun. 30, 1978

Related U.S. Application Data

[63] Continuation of Ser. No. 805,981, Jun. 13, 1977, Pat. No. 4,100,746.

[51] Int. Cl.[2] ..... E02B 3/00

[52] U.S. Cl. ..... 405/63; 405/70

[58] Field of Search ..... 61/1 F; 405/63, 70, 405/72, 71

[56] References Cited

U.S. PATENT DOCUMENTS

| | | | |
|---|---|---|---|
| 3,456,265 | 7/1969 | Carnahan | 405/63 X |
| 3,691,773 | 9/1972 | Ruhlman | 405/70 |
| 4,100,746 | 7/1978 | Preus | 61/1 F |

FOREIGN PATENT DOCUMENTS

| | | | |
|---|---|---|---|
| 1558927 | 1/1969 | France | 405/63 |

OTHER PUBLICATIONS

Clean Water, Inc., "Sheltered Water Oil Boom," (1973).

*Primary Examiner*—Mervin Stein

*Attorney, Agent, or Firm*—Harold L. Stowell

[57] ABSTRACT

Aquatic sports zones are reclaimed or made by bounding non-shore areas of the zone with a plurality of end-to-end connected water impervious flotation boom sections, anchoring the formed boom in the bound zone, and attaching the ends of the boom to pier bulkheads, and providing the boom with a ballasted skirt having a length greater than the maximum normally anticipated water depth at the point of attachment of the skirt to the boom. Where desired, water purification means may be included in the bound zone.

1 Claim, 9 Drawing Figures

PROTECTED AQUATIC SPORTS AREA

This is a continuation of application Ser. No. 805,981, filed June 13, 1977, now U.S. Pat. No. 4,100,746, issued July 18, 1978.

BACKGROUND OF THE INVENTION

Field of the Invention

This invention is directed to means and a method for reclaiming or making a protected and pollution-free aquatic sports area in lakes, rivers, ponds and ocean and bay beach areas.

Expanding industry and over population have forced the closing of many lake, river, and ocean swimming and diving areas due to excessive pollution of the bodies of water. Areas have also been forced to close due to periodic hazardous tides and the invasion of such areas by noxious animal life such as sea nettles, sharks, blue fish and the like, which are harmful to bathers in the area. Further, such conditions have prevented opening of many aquatic sports areas.

It is therefore a principal object of the present invention to provide a system and means whereby such aquatic sports areas may be reclaimed or made at a relatively small cost to governmental, municipal, or private establishments, groups or individuals.

SUMMARY OF THE INVENTION

The objects and advantages of this invention are provided by a method for reclaiming or making an aquatic sports zone in a portion of a lake, river, ocean, or the like, comprising bounding the non-shore area of the zone with a plurality of end-to-end connected water impervious flotation boom sections, anchoring the formed boom in the bound zone, attaching the ends of the formed boom to pier bulkheads and providing to the boom a ballasted skirt having a vertical length greater than the maximum normally anticipated water depth at the point of attachment of the skirt of the boom.

BRIEF DESCRIPTION OF THE DRAWING

The invention will be more particularly described in reference to the accompanying drawing wherein.

DESCRIPTION OF THE PREFERRED EMBODIMENTS

Figure 1:
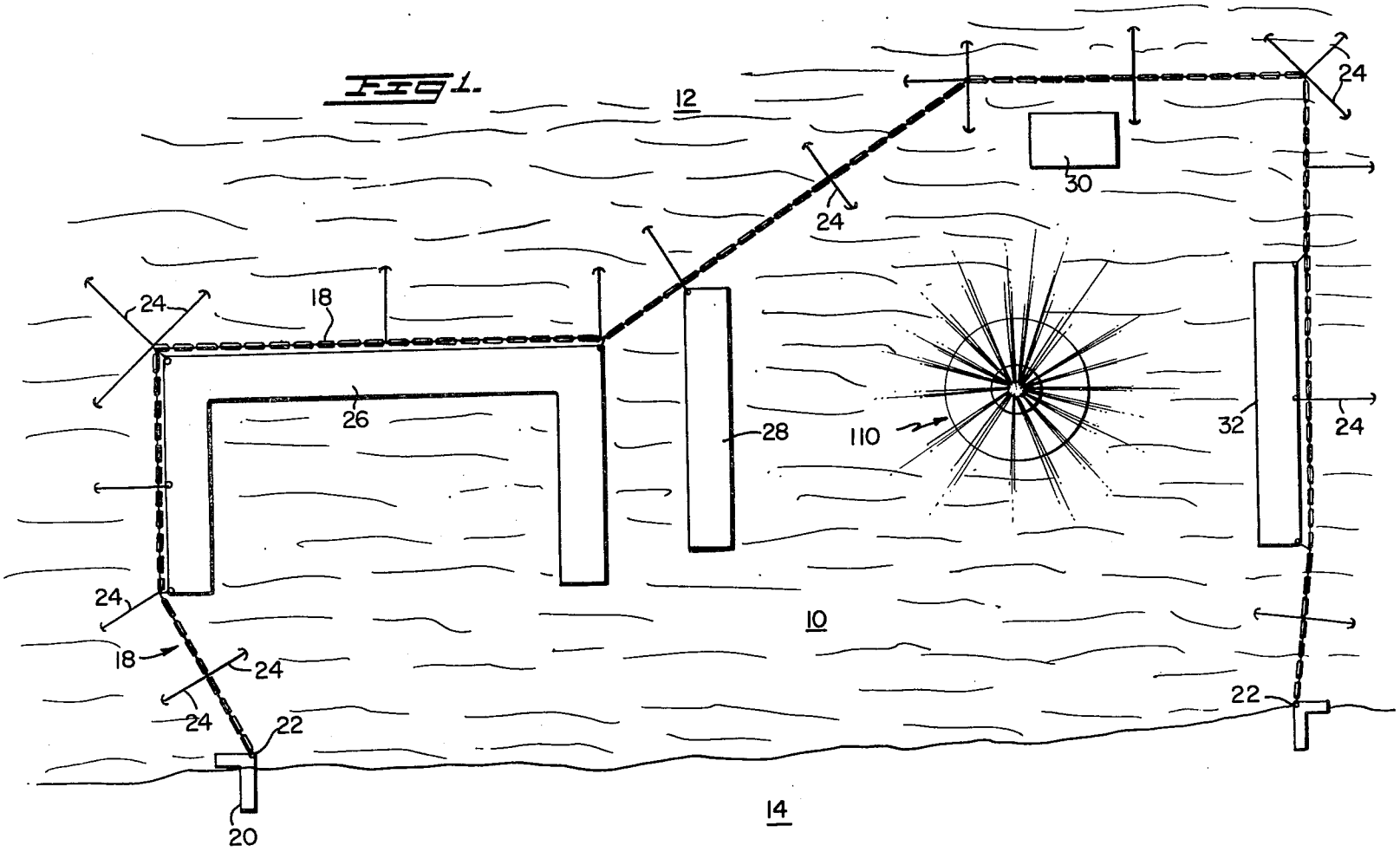
FIG. 1 is a diagrammatic top plan view of an apparatus adapted to carry out the method of the present invention.

Referring to the drawings, and in particular to FIGS. 1 through 6, 10 generally designates an aquatic sports zone reclaimed or made by impounding water from a larger body of water 12, which may be a portion of a lake, a river, a bay, the ocean, or the like. In the illustrated form of the invention, the impounded area 10 has one boundary bordering a portion of the shore 14 and the other boundaries are composed of a plurality of boom segments 16 which, when joined together, form the boom generally designated 18.

In order to anchor the boom 18 to the shore and to prevent water from the larger body 12 from invading the area 10 at the shoreline, a pair or pier bulkheads generally designated 20 are provided for each end 22 of the boom 18.

The boom 18, details of which will be further described hereinafter in association with FIGS. 2 through 6, is maintained in its desired configuration by anchoring the boom to ground anchor assemblies designated 24 and to stationary swimming and diving platforms designated 26, 28, 30 and 32 in FIG. 1.

The number of such stationary swimming and diving platforms and the like impounded within the zone 10 depends on the use of the aquatic sports zone and the size of the impounded area. By a way of example and to provide an estimate of the total impounded area illustrated, the frontage between pier bulkheads 20 is about 340 feet and the total lineal feet of flotation barrier is about 750 feet.

Referring now more specifically to FIGS. 2 through 6, the boom is composed of a plurality or series of boom sections 16. Portions of two boom sections are shown in FIGS. 3 through 6. Each of the boom sections comprises a generally tubular element 44 and a depending skirt 46. The tubular sections 44 may be provided with an upstanding fin 48 provided with hand grips 50 at spaced intervals therealong.

The handles or hand grips 50 are useful in deploying the boom sections and may be used as safety hand grips by swimmers.

The upstanding fin 48 is useful in reducing slop-over of the water between the lake and that being contained within the boom by wind, currents and wave action.

The tubular portions 44 include a plurality of inflation chambers 44', or, as to be further described, suitable flotatable material such as cork, foam plastics such as urethane foams and the like may be inserted in the tubular chambers.

The tubular portions of the boom are impervious, and a nylon reinforced, plastic coated fabric has been found to be very satisfactory.

Figure 5:
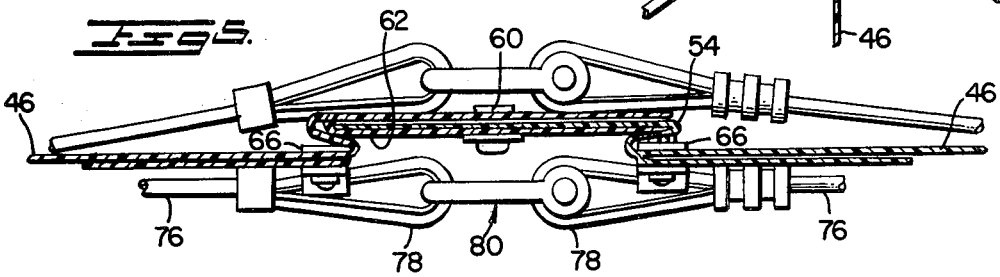
FIG. 5 is a section on line 5—5 of FIG. 3.
Figure 6:
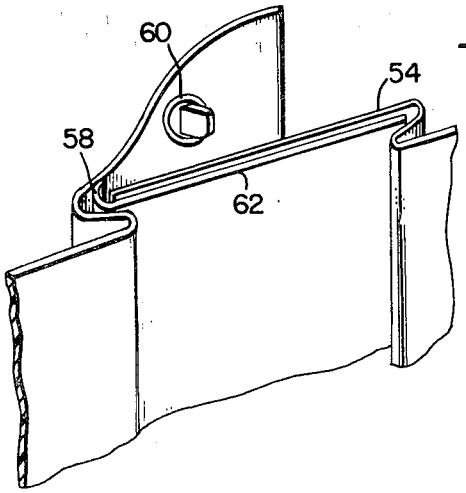
FIG. 6 is an enlarged diagrammatic illustration of a form of a connecting joint for the boom sections illustrated in FIGS. 2 through 5.

One end of each boom section 16 has an extended end portion 54 provided with a plurality of vertically aligned openings containing grummets. The opposite end of each boom section 16 is provided with an extended flap portion 58, which extended flap portion receives a plurality of fasteners 60 of the sister hook type with the fasteners 60 aligned with the openings in extended flap 54 of the other end of the next adjacent boom section. Further, each end 58 has stitched thereto a secondary flap 62 to provide a furcated closure adapted to receive extended flap 54 of the opposite end of the adjacent boom section. The sewn flap 62 has a plurality of vertically aligned openings provided with grummets and in assembly the flap 54 is inserted between flaps 58 and 62 and the sister fasteners 60 are pressed through the grummets in flaps 54 and 62, then turned, as illustrated in FIG. 5 to provide an overlapping seal between boom sections.

Figure 3:
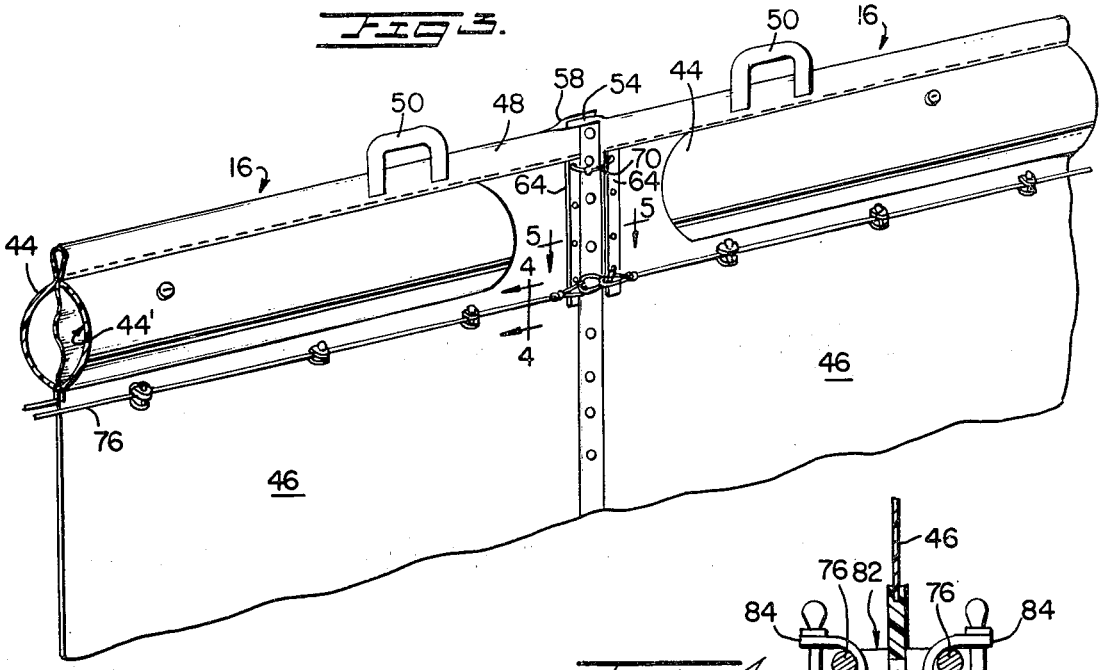
FIG. 3 is an enlarged fragmentary partially sectional view of a pair of boom sections.
Figure 4:
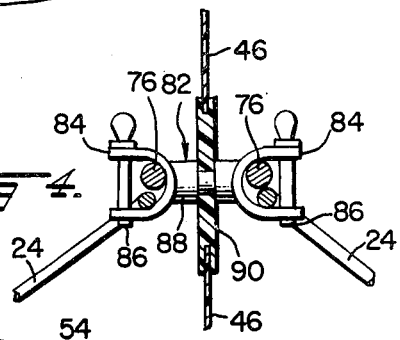
FIG. 4 is a section on line 4—4 of FIG. 3.

In the vertical zone of the tubular portion 44, each end of each boom section 16 is provided with a metal or the like stiffening rod 64 for one side and 66 for the other, which rods are bored to receive nut and bolt assemblies. The uppermost bolts of adjacent ends of adjacent boom sections 16 also secure to the booms a short length of chain or a pair of clevis connectors generally designated 70, as illustrated in FIG. 3. The total length of the connectors 70 is materially less than the length of the end flaps 54, 58 and 62 so that the strain between boom sections is taken up in part by the connector 70 and transmitted to the pair of metal plates thence to the boom to thereby relieve all strain on the flap-like closures hereinbefore described.

Also, as illusted in FIGS. 2 and 5, at the upper end of each skirt portion 46 and immediately below the tubular portions 44 of each boom section 16 is provided a pair of flexible draft members composed of wire, chain or cable and designated 76 having eyes 78 at each end, which eyes have a portion thereof positioned behind the plates or bars 66, as more clearly shown in FIG. 5. The ends of the loops 78 of adjacent wires 76 are connected by clevis fastener 80. The fastener 80 and the loops or eyes 78 are so sized that the pair of adjacent metal plates 66 are spaced as shown in FIG. 5 to relieve all tension on the flap-type connectors comprising flaps 54, 48 and 62. Further, such elements are sized to have a length equal to the connectors 70 joining the upper ends of the stiffening rods 64 and 66.

The cables or chains 76 are connected to the boom sections by double-ended clevis connectors generally designated 82. The clevises 84 of the double-ended clevis connectors 82 have removable pins 86 between the furcations of the clevises so that the cables 76 and anchoring cables 24 may be inserted between the furcations as more clearly illustrated in FIG. 3.

The shank portion 88 of each of the double-ended clevis connectors passes through a resilient grummet 90 in the fabric of the skirt 46. It has been found that placing the clevises, for example, every foot apart provides adequate anchoring of the cable 76 to the boom sections.

Figure 2:
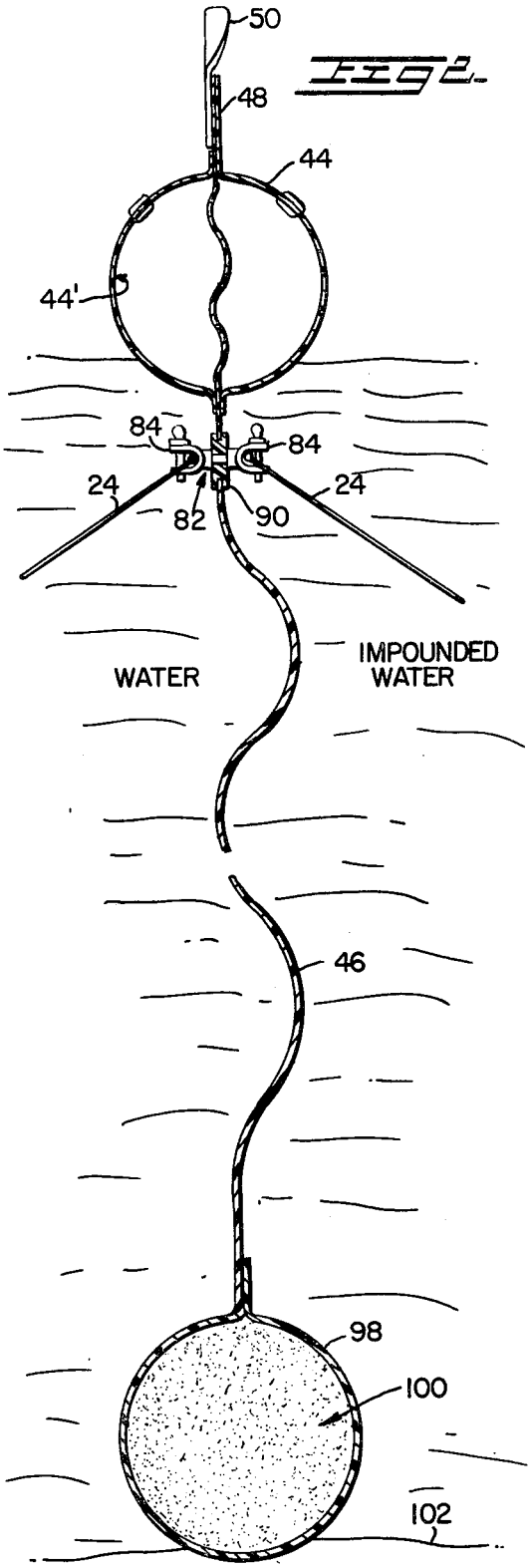
FIG. 2 is a longitudinal sectional view through a portion of the impoundment barrier illustrated in FIG. 1.

At the lower end of each of the boom section skirts 46 is provided a tubular pouch or pocket 98 extending substantially the entire length of each skirt, as more clearly illustrated in FIG. 2 of the drawings. The tubular pouches or pockets are filled with a ballasting material such as sand 100. Where the flotation means comprises air chambers, pouches 98 having a diameter of about 8 inches and filled with sand have been found to be fully adequate for lake and river applications. larger and heavier ballasting would be required where substantial wave action is anticipated such as in large lakes, bays and ocean shores.

The length of the skirts 46 vary with the depth of the water at the particular boom section location and the length includes an amount which will permit the ballasting tube and ballast 98–100 to remain in contact with the floor of the water body designated 102 in FIG. 2, even during the anticipated maximum height of the water to be impounded, thus, if the depth of the water at a boom section varies between 10 and 12 feet, the length of the skirt plus the diameter of the ballast tube 98 would be in the neighborhood of about 13 to 14 feet. It will also be appreciated that the length of the skirt 46 at various locations throughout the impounding area would be different depending upon the actual measured depth of the water.

In the form of the invention illustrated particularly in FIGS. 2 through 6, the skirt 46 is made integral with the tubular portion 44 either by forming the tubular portion and the skirt from a single sheet of impervious plastic-coated fabric or by stitching an independent skirt to the tubular portion 44.

Figure 7:
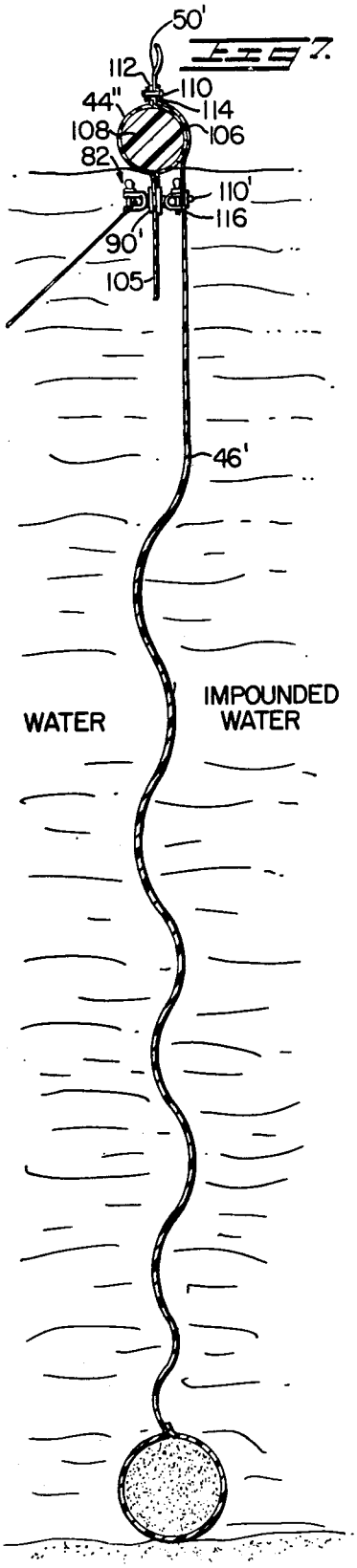
FIG. 7 is a view like FIG. 2 of a modified form of the present invention.

In the FIG. 7 form of the invention, the skirt 46' is non-integral with the tubular portion 44'' of boom section 16' and such form of construction provides a simple procedure for deploying the impounding boom. In the FIG. 7 form of the invention, the tubular portion 44'' has a short skirt 105 and an upstanding fin 48'.

The short skirt 105 is provided with grommets 90' which receive the double-ended clevis connectors 82' as in the other form of the invention.

The long skirt 46' extends upwardly over one side of the tubular portion 44'', as illustrated at 106, and is laced to the fin 48' and to one of the cables 76' by cables 110–110' passing through grummeted openings 112–114 in the fin and in the upper end 106 of the skirt 46' and grummeted openings 116 adjacent said one cable 76'.

Also as illustrated in FIG. 7, the flotation means, instead of comprising inflatable chambers, comprises chambers containing, for example, closed cell plastic foam generally designated 108.

Figure 8:
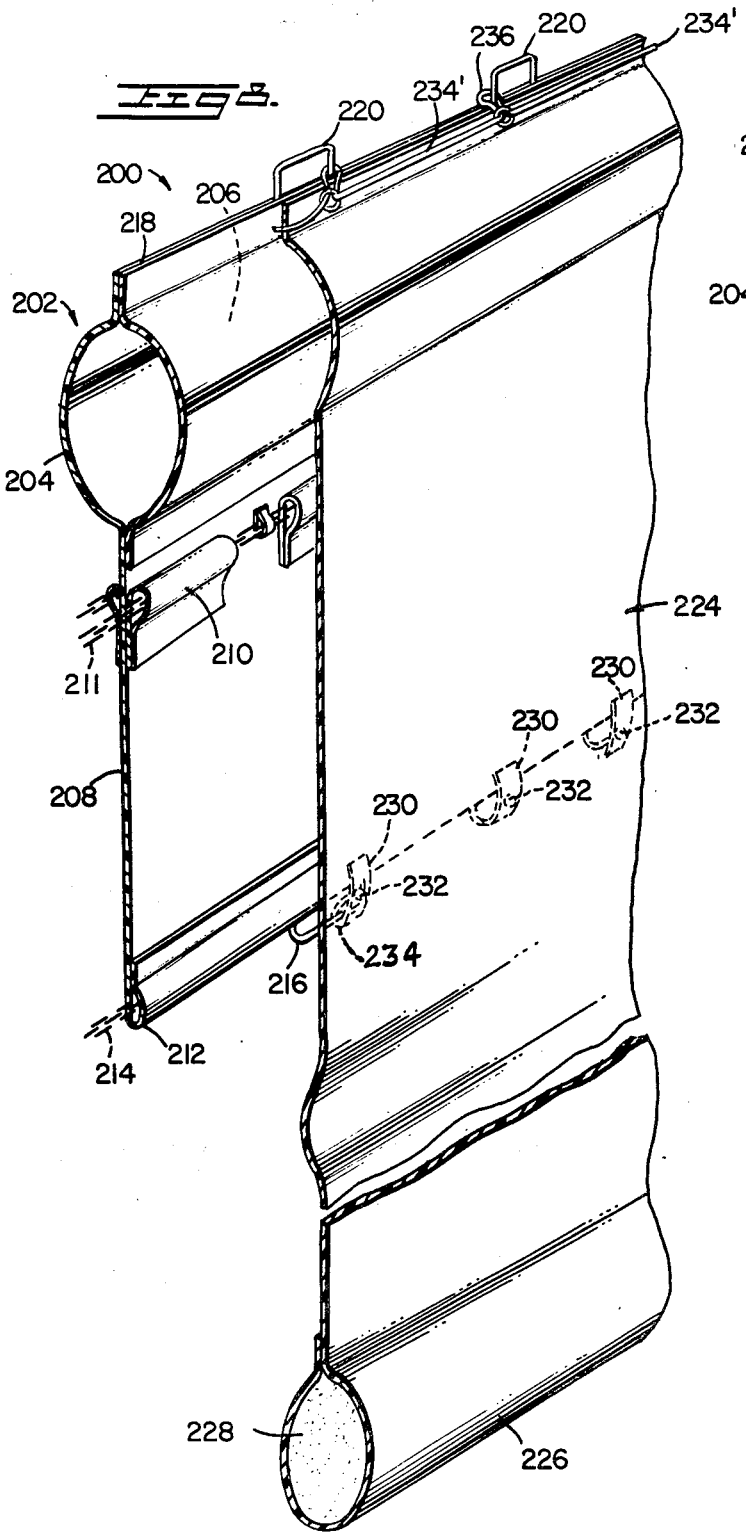
FIG. 8 is a perspective view of a further form of the present invention.
Figure 9:
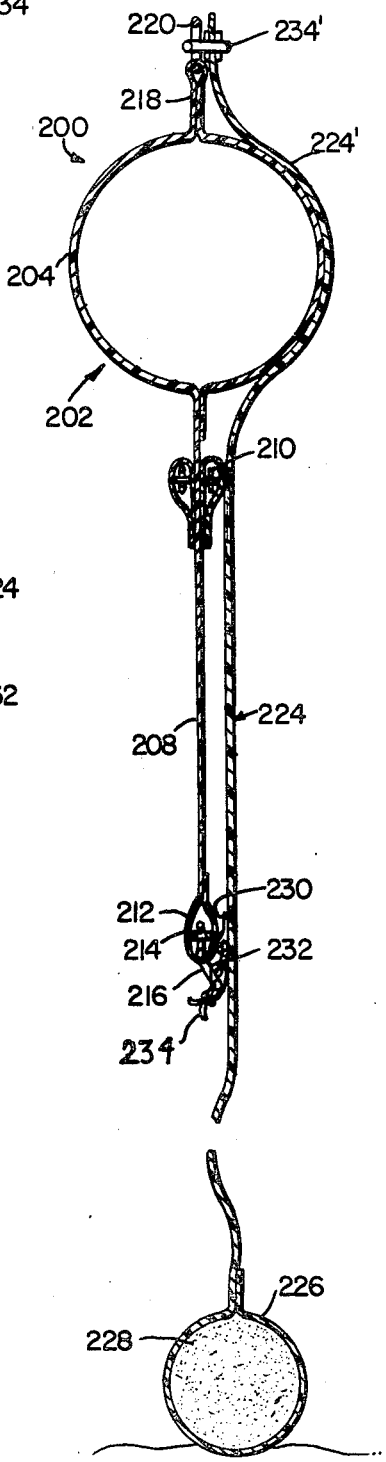
FIG. 9 is a section on line 9—9 of FIG. 8.

Referring now particularly to FIGS. 8 and 9, there is illustrated another form of boom means for constructing or reclaiming swimming or other aquatic sports zones in larger bodies of water.

In FIGS. 8 and 9, 200 generally designates a dual air chamber inflatable boom of the type employed in booming off oil spills and the like. The inflatable boom comprises a plurality of boom sections 202, each of which generally includes a tubular element 204 containing an air chamber or chambers 206 spaced therealong which flotation elements may be like those illustrated in the FIGS. 2–6 or 7 forms of the invention.

The assembly also includes a skirt portion 208 which may have a length of approximately two feet. Along each side of the skirt 208, in pouches 210, are maintained chains 211 which may be further connected to the skirt 208 by connectors as illustrated at 82 in the prior described forms of the invention. The lower end of the skirt 208 also is provided with a pocket or pouch 212 containing a lower ballast chain 214.

Secured such as by sewing or vulcanizing or heat sealing to the lowermost edge of the skirt 208 are a plurality of handles or hand grips 216. Placement of the handles at a distance apart of, for example, 18 inches has been found to be very satisfactory. It will be recognized, however, that the spacing may be greater or less as the particular water situation may dictate.

The boom also includes an upstanding sail or spoiler 218 provided with top handles 220 again spaced in the order of about every 18 inches. Each of the boom segments may be secured one to the other as described in reference to the FIGS. 2–6 form of the invention.

In order to provide the water retaining skirt generally designated 224, an impervious skirt is manufactured having a length greater than the distance from the top handles 220 of the harbor boom 200 to the bottom of the water at the point of impoundment. The impervious skirt 224 is provided with a lower pouch 226 containing a ballast material 228 such as sand or the like.

Adjacent the handles 216, along the lower edge of the harbor boom skirt 208, are sewn to the skirt 224 a plurality of tabs 230 which may be constructed of the same material as the skirt 224. These tabs, in the illustrated form of the invention, are two inches wide and seven inches long and adjacent the lower edge of each tab is provided a grummet 232. Preferably the tabs are spaced 18 inches apart and correspond to the spacing of the handles 216 in longitudinal direction and the tabs 230 are spaced in the vertical direction such that the grummets 232 are approximately 2 inches below the bottom of the handles 216 when the skirt is in place.

In order to secure the tabbed grummets and thus the skirt 224 to the handles 216, a coated ¼th inch diameter, for example, aircraft cable is then reeved through the grummets and through the corresponding bottom handles 216 as illustrated in the drawings with the weaving wire being designated 234. With this form of construction, basically the weight of the skirt 224 is carried from the lower end of the harbor boom 200 assisting in maintaining the boom in a vertical position as illustrated in FIG. 9. The upper portion of the skirt designated 224' is provided with a plurality of grummets 236 spaced along the upper edge coincident with the upper handles 220 and again a coated cable is reeved through the grummets and the handles with the cables being designated 234'. With this form of construction, the barrier skirt is connected to the boom in two spaces as was the skirt 46' in the FIG. 7 form of the invention.

Where desired, the top wire 234' at its point of passage about each of the handles 220 may be secured thereto by a conventional wire clamp, one of which is illustrated at 236 in FIG. 8 of the drawing. By so securing the wire to the handles, shifting of the fabric is kept to a minimum.

From the foregoing, it will be seen that novel means are provided for reclaiming or making protected aquatic sports areas. It will also be recognized by those skilled in this art that various modifications may be made in the form of construction of the barrier without departing from the scope of the present invention. For example, instead of lacing the top of the skirt 224, for example, to the upper portion of the harbor boom 200, the connection may be made by using common sister hook type fasteners with, for example, the male portion of the sister fastening being secured to the fin 218 while adjacent portions of the upper edge of the skirt receives the female portion of the sister hooks. Instead of the common sister hook type fasteners the skirt may be secured to the upper and lower portions of the harbor boom using conventional zipper type connections.

In general, it has been found that the boom sections 16–16', each having a length of about 50 feet, provides very satisfactory results. However, the length of each section may be from 2 feet to 100 feet and the diameter of each tubular section 44 may be from 3 inches to as much as 36 inches; however, 8-inch flotation means are very satisfactory.

One of the additional advantages of the present form of construction is that, if the skirt and/or tubular sleeve become worn or torn, the hardwear such as the cables 76, the connectors 80, etc., chain 88, etc., and the flotation unit 108 may be reused with a new fabric sleeve and skirt.

Referring again to FIG. 1 of the drawings, when the impounded area of zone 10 is in water which is particularly polluted, after the impounded area has been sealed off from the remainder of the body of water, the impounded water may be subjected to filtration by means of conventional swimming pool-type filtration equipment and a noval means of discharging the filtered water into the impoundment area is via a fountain such as generally designated at 110 in FIG. 1.

What is claimed is:

1. An isolated and protected aquatic sports zone in a portion of a larger shore-bounded body of water comprising a pair of spaced pier bulkheads defining the length of the protected zone along the shore of the body of water, a plurality of water impervious boom sections, each of said boom sections including a generally tubular flotation element and an integral water impervious depending skirt, each tubular element having an upstanding fin and hand grips spaced along said fin, each depending skirt having balasting means along the lower edge thereof and means connecting each tubular element and depending skirt in end-to-end relation, means connecting the ends of the connected boom sections to said pair of spaced pier bulkheads, a second skirt member, means releasably connecting the top of the second skirt member to the top of the flotation elements, further means releasably connecting the lower end of the integral skirt to said second skirt, said second skirt having a length greater than the depth of the water at the point of deployment and ballasting means carried at the lower end of said second skirt, anchor means, means attaching the anchor means to the boom sections at spaced intervals to thereby define a fixed protected aquatic sports zone, a pair of draft members positioned on opposite sides of the upper end of th integral skirt, means cross-connecting the draft members together through the integral skirt, characterized in that the means cross-connecting the draft members together through the integral skirt, comprises a rigid double-ended clevis with each clevis of the double-ended clevis having removable pins between the furcations thereof whereby the draft members and the means connecting the anchor means to the boom sections may be removably inserted between the furcations of each double-ended clevis.

* * * * *